US005082455A

United States Patent [19]

Wei

[11] Patent Number: 5,082,455

[45] Date of Patent: Jan. 21, 1992

[54] LOCK ASSEMBLY OF A DIN TYPE CONNECTOR

[76] Inventor: Mu-Kang Wei, No. 160, Chung-chen Road, Sec. 2, Hu-Kou Hsiang, Hsinchu, Taiwan

[21] Appl. No.: 642,798

[22] Filed: Jan. 18, 1991

[51] Int. Cl.[5] ..... H01R 13/627

[52] U.S. Cl. ..... 439/352

[58] Field of Search ..... 439/350, 352, 353, 354, 439/355, 357, 358

[56] References Cited

U.S. PATENT DOCUMENTS

| | | | |
|---|---|---|---|
| 4,548,455 | 10/1985 | Ezure | 439/352 X |
| 4,810,210 | 3/1989 | Komatsu | 439/352 X |
| 4,915,642 | 4/1990 | Lin et al. | 439/352 |
| 4,929,189 | 5/1990 | Sekiguchi | 439/352 |
| 4,954,097 | 9/1990 | Sekiguchi | 439/352 |

*Primary Examiner*—Neil Abrams
*Assistant Examiner*—Khiem Nguyen
*Attorney, Agent, or Firm*—Morton J. Rosenberg; David I. Klein

[57] ABSTRACT

A lock assembly of a DIN type connector, which includes a first cover and a second cover associated with a coupling to provide a lock system for locking the connector. The connector has a housing, a first cover, a body, a coupling, a second cover, a coil spring, and a cap; wherein the coupling has two slider levers, each with a respective hole, and the second cover. The second cover has two legs, each passing through the hole in a respective slider lever, and each having a respective protrusion, which form a locking system to lock the parts of the connector and base firmly, but are capable of being disassembled by an easy operation.

1 Claim, 4 Drawing Sheets

LOCK ASSEMBLY OF A DIN TYPE CONNECTOR

BACKGROUND OF THE INVENTION

The present invention relates to a lock assembly of a DIN type connector, which includes a first cover and a second cover associated with a coupling to provide a lock system for locking the connector.

In the prior art, most DIN type connectors do not provide any means for locking the connection elements. Parts of the prior art connectors are always loosened by vibration or an external force, and the connectors are therefore made unusable because of improper contact. There have been a few improvements made to provide an external lock to connect the parts firmly, but these lock systems have been too large to be practical.

SUMMARY OF THE INVENTION

It is the purpose of this present invention, therefore, to mitigate and/or obviate the abovementioned drawbacks in the manner set forth in the detailed description of the preferred embodiment.

A primary objective of this invention is to provide a lock assembly of a DIN type connector, which includes a locking system having two covers and a coupling associated with a housing to lock the assembly firmly.

Another objective of the present invention is to provide a lock assembly of a DIN type connector, which is capable of being disassembled by an easy operation.

Further objectives and advantages of the present invention will become apparent as the following description proceeds, and the features of novelty which are characterized in the Claims annexed to and forming a part of this invention.

DETAILED DESCRIPTION OF THE PREFERRED EMBODIMENT

Figure 1:
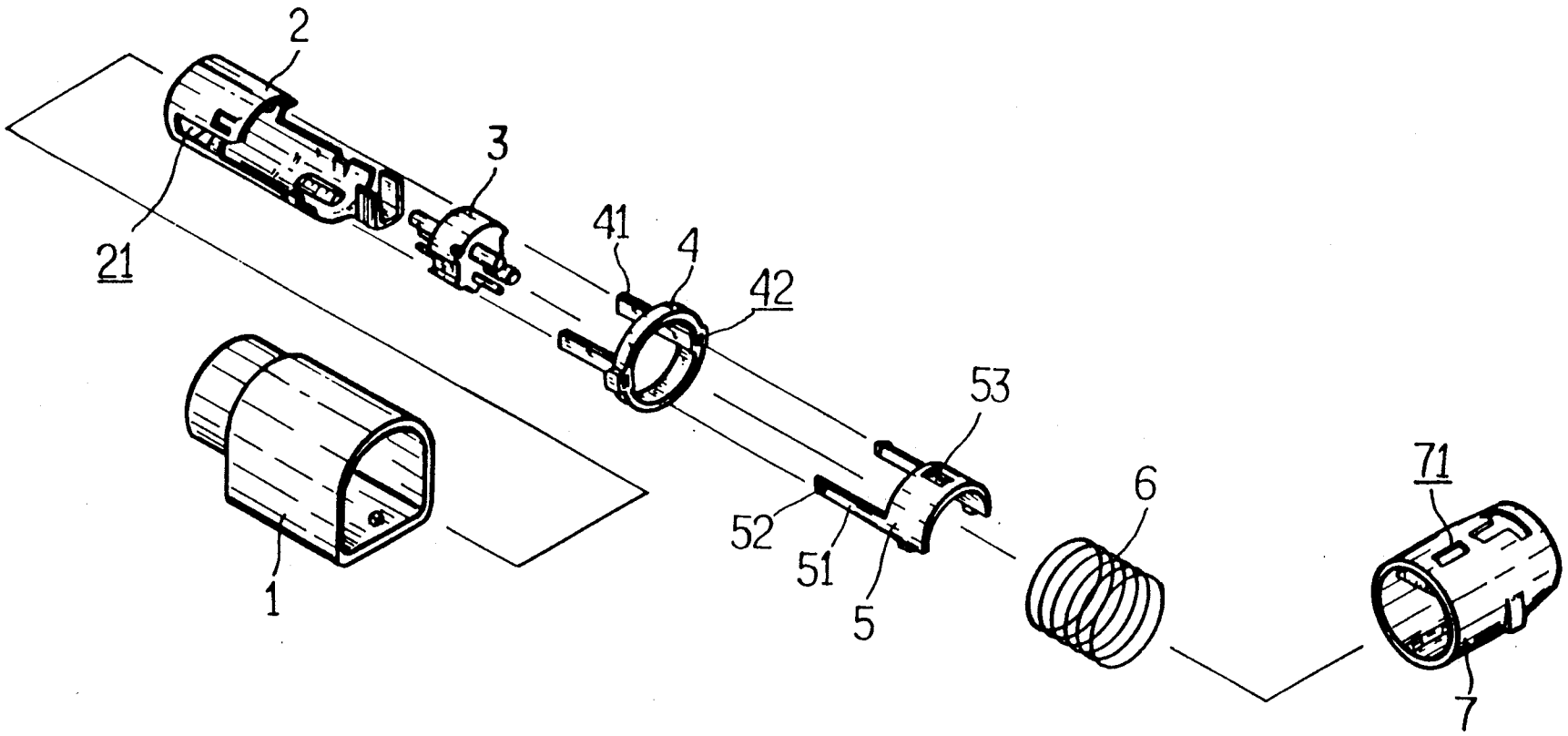
FIG. 1 is an exploded perspective view of a preferred embodiment of the present invention.

Referring to FIG. 1, it can be seen that the present invention includes a housing 1, a first cover 2, a body 3, a coupling 4, a second cover 5, a coil spring 6, and a cap 7. The couplilng 4 has two slider levers 41, each having a respective hole 42. The second cover 5 has two legs 51, each having a respective protrusion 52 disposed on the distal end to pass through the holes 42, and a hook 53 located on the top surface of cover 5.

Figure 3:
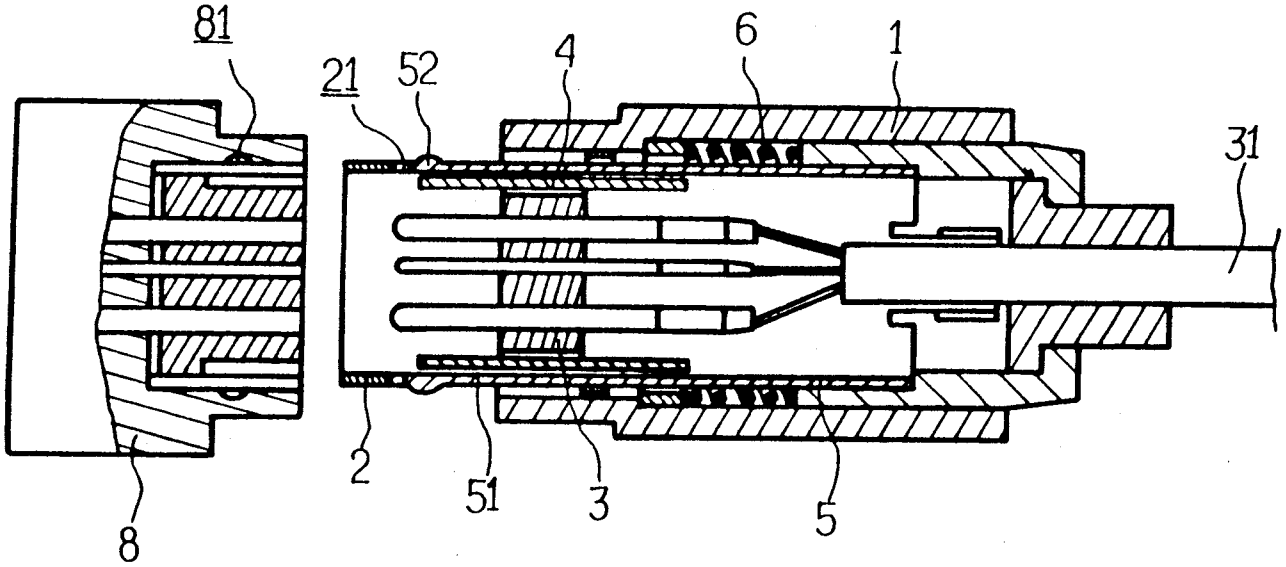
FIG. 3 is a cross-sectional view of a preferred embodiment of the present invention showing the connector elements in a separated manner.

Referring to FIG. 3, it is shown that the first cover 2, the coupling 4 connecting with the second cover 5, the coil spring 6, and the cap 7 are placed inside the housing 1 in series. The two holes 21 are formed on opposing sides of the first cover 2. The two protrusions 52 on the legs 51 of the second over 5 are positioned to pass through the holes 21, respectively.

Figure 2:
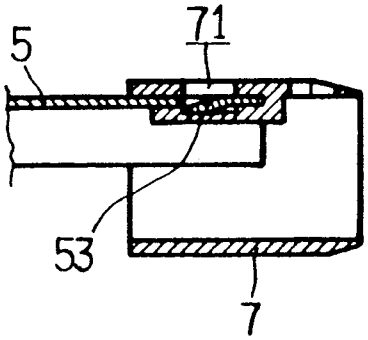
FIG. 2 is a cross-sectional view of a preferred embodiment of the present invention showing the manner of connection between a second cover and the cap.

As shown in FIG. 2, a groove 71 is formed on the cap 7 for engagement with the hook 53 of the second cover 5, subsequent to connection of those parts. The body 3 is connected with a cable 31, and is placed inside the coupling 4 to complete a DIN type connector.

Figure 4:
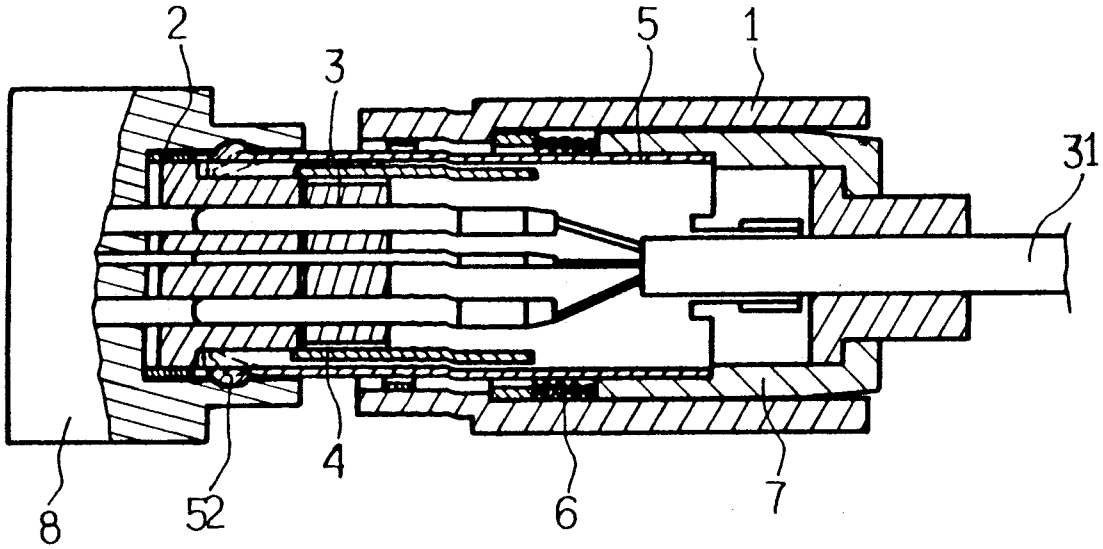
FIG. 4 is a cross-sectional view of a preferred embodiment of the present invention showing the connector elements in a connected manner.

When the connector is inserted into a base 8, as shown in FIG. 4, pins of the body 3 are engaged with seats of the base 8, and the two protrusions 52 of the second cover 5 are each engaged with a respective one of two channels 81 formed in the base 8. Since the respective ends of the levers 41 are positioned adjacent and internal to the legs 51, the protrusions 52 are difficult to disengage from the channels 81. In order to separate the connector from the base, the housing 1 and the coupling 4 must be moved rearward, compressing the coil spring 6, in the manner shown in FIG. 4. The ends of the levers 41 are thereby displaced away from the protrusions 52 of the second cover 5. Thus, the legs 51 of the second cover 5 are free to elastically deform to permit disassembly of the connection (as shown in phantom in FIG. 4).

It is to be understood that the present invention can provide a lock system to engage the connector with the base firmly when they are connected. The coil spring 6 provides a sufficient force to prevent disassembly of the connector parts from vibration or external forces. The DIN type connector is still capable of being disassembled by an easy manual operation.

As various possible embodiments might be made for the above invention without departing from the scope of the invention, it is to be understood that all matter herein described or shown in the accompanying drawings is to be interpreted as illustrative and not in a limiting sense. Thus it will be appreciated that the drawings are exemplary of a preferred embodiment of the invention.

I claim:

1. A lock assembly of a DIN type connector, comprising:

a tubular housing having a longitudinally extended passageway extending therethrough, said passageway having a shoulder formed therein;

a first cover member having a cylindrical portion formed on one end thereof, said first cover member being slidingly received within said passageway of said housing, said first cover member having a pair of slotted through openings formed on opposing sides of said cylindrical portion;

a body member coupled to said first cover member for positionally locating and supporting electrically conductive pins within said cylindrical portion of said first cover member;

a coupling slidably coupled to said body member, said coupling having (1) a base portion defined by an annular ring, and (2) a pair of lever members extending axially from said annular ring, said annular ring having a pair of through openings formed therein, each of said pair of through openings being disposed adjacent a respective one of said pair of lever members and extending axially through said annular ring;

a second cover member coupled to said first cover member, said second cover member having a pair of legs extending axially from opposing sides thereof, each of said legs being received within a respective one of said slotted through openings formed in said first cover member, each of said legs having a protrusion formed on a distal end for locking interface with a mating connector, each of said legs being slidingly received within a respective one of said through openings formed in said second cover member for additional support thereof, each of said lever members being disposed adjacent an inner surface of a respective one of said legs;

a coil spring overlaying at least a portion of said second cover member and having a first end contacting said annular ring of said coupling for applying a bias force thereto; and, a cap member coupled to said second cover member, said cap member being received within said housing and contacting a second end of said coil spring, whereby said legs are free to disengage from said locking interface responsive to a rearward displacement of said housing against said bias force, said shoulder of said housing engaging said annular ring for displacing said lever members rearwardly.

* * * * *